US005758706A

United States Patent [19]

Bäckerud et al.

[11] Patent Number: 5,758,706

[45] Date of Patent: Jun. 2, 1998

[54] PROCESS CONTROL OF COMPACTED GRAPHITE IRON PRODUCTION IN POURING FURNACES

[75] Inventors: Stig Lennart Bäckerud, Katrineholm; Conny Andersson, Eskilstuna, both of Sweden

[73] Assignee: Sintercast AB, Stockholm, Sweden

[21] Appl. No.: 676,107

[22] PCT Filed: Dec. 7, 1994

[86] PCT No.: PCT/SE94/01177

§ 371 Date: Jul. 1, 1996

§ 102(e) Date: Jul. 1, 1996

[87] PCT Pub. No.: WO95/18869

PCT Pub. Date: Jul. 13, 1995

[30] Foreign Application Priority Data

Jan. 4, 1994 [SE] Sweden ..... 9304347

[51] Int. Cl.[6] ..... B22D 46/00; B22D 27/00

[52] U.S. Cl. ..... 164/4.1; 164/57.1; 164/58.1

[58] Field of Search ..... 164/4.1, 57.1, 164/58.1, 150.1, 151.4

[56] References Cited

U.S. PATENT DOCUMENTS 4,046,509 9/1977 Bäckerud ..... 164/4.1
4,246,026 1/1981 Stefanescu et al. .
5,337,799 8/1994 Backerud ..... 164/4.1

FOREIGN PATENT DOCUMENTS 0 157 308 10/1985 European Pat. Off. .
52-026039 8/1975 Japan .
WO 86/01755 3/1986 WIPO .
WO 91/13176 9/1991 WIPO .
WO 92/06809 4/1992 WIPO .
WO 93/20965 10/1993 WIPO .

*Primary Examiner*—Joseph J. Hail, III
*Assistant Examiner*—L.-H. Lin
*Attorney, Agent, or Firm*—IP Group of Pillsbury Madison & Sutro LLP

[57] ABSTRACT

A method for continuously providing pretreated molten iron for casting objects which solidify as compacted cast iron, in which inoculating agents are added immediately prior to casting, in exact quantities. In practicing the method, the ability of the fully treated cast iron to crystallize is measured and the result of this measurement is used for feedback control of the supply of inoculating agent, this supply being effected at the last possible stage of the treatment process, so as to optimize the amount of inoculating agent introduced to the system. Since the inoculating a gent will normally include FeSi, it will also fed back and used to increase or reduce the addition of agents for adjusting the carbon and/or silicon contents of the iron as necessary.

12 Claims, 3 Drawing Sheets

PROCESS CONTROL OF COMPACTED GRAPHITE IRON PRODUCTION IN POURING FURNACES

This application claims benefit of international application PCT/SE94/01177 filed Dec. 7, 1994.

BACKGROUND OF THE INVENTION

The present invention relates to a method for providing pretreated molten iron for casting objects which solidify as compacted graphite iron.

Compacted graphite iron, below abbrivated as CGI, is a type of cast iron in which graphite appears in a vermicular form (also referred to as compacted cast iron or vermicular iron) when viewed on a two-dimensional plane of polish; vermicular graphite is defined as "Form III" graphite in ISO/R 945-1969, and alternatively "Type IV" according to ASTM Specification A 247.

The mechanical properties of CGI are a combination of the best properties of gray iron and ductile iron. The fatigue strength and ultimate tensile strength of CGI are comparable with the values for pearlitic ductile iron, while the thermal conductivity of CGI is similar to that of gray iron. In spite of this, CGI presently represents only a limited part of the total world production of cast iron, as compared with gray iron which constitutes about 70% of the total cast iron production, and ductile iron which constitutes about 25% of total production.

One reason for the prior limited production of CGI is because of the difficulty and reliably producing it. This difficulty stems from the fact that the graphitization potential and the graphite shape-modifying elements of the iron must be simultaneously controlled within a very narrow range during the production process. This has been achieved hitherto with the aid of a large number of tests and experientially well-defined and often expensive additions to the system. However, theses difficulties have been removed in the most part by the methods described in SE-B-444,817, SE-B-469,712 and SE-B-470,091. SE-B-444,817 describes a method of producing cast iron which includes graphite shape-modifying agents, this method being based on a thermal analysis which enables the graphite precipitation and growth to be established based upon the actual solidification process of a small and representative sample and to finally treat the melt with additional graphite shape-modifying elements as required for optimal solidification of CGI upon casting. The time-dependant change in temperature in the center of a sample and at a point in the melt lying close to the wall of the sampling vessel during the solidification process is recorded, whereby two different solidification curves are obtained which can be used to provide information relating to the course of solidification in a casting process. Since this sampling method provides quick and very precise information concerning the inherent crystallization properties of the melt, the subject matter of SE-B-444,817 represents a first realistic possibility of controlling the production of CGI on a large scale.

SE-B-469,712 teaches a development of the method taught by SE-B-444,817, in which there is used a special type of sample container having walls supplied with a substance which lowers the concentration of elementary magnesium dissolved in the melt close to the container wall by at least 0.003%. This is done to create a margin against such lowering of the Mg-content as to result in the formation of flaky graphite; with regard to elementary Mg, the transition from the formation of compacted graphite to the formation of flaky graphite namely extends over a concentration range of only 0.003 percentage units, principally from 0.008% to 0.005%, although the absolute values may vary depending on the solidification time.

SE-B-470,091 describes a further development of the method taught by SE-B-444,817. This patent specification describes how it is also possible to determine the physical carbon equivalent (C.E.) or graphitization potential of structurally modified cast iron melts, among others CGI which has a C.E.-value higher than the eutectic point. Again, the thermal analysis results are used to correct or regulate the composition of the melt. The method is based on introducing into a sample vessel pieces of iron of low carbon content, wherein the size of the pieces is adapted so that the pieces will not melt completely when the vessel is filled with molten iron. The temperature of the melt is recorded as the melt solidifies. When the temperature crosses the γ-liquidus line, this temperature is recorded as an absolute temperature or as a temperature difference in relation to the measured and calibrated values of the eutectic temperature for structurally modified cast iron of a similar kind; the C.E. of the melt is determined on the basis of a phase diagram for this structurally modified cast iron.

The teachings of these patent specifications represent in all essentials the state of the art on which the methods of producing CGI of uniform quality on an industrial scale are based. This was scarcely realistic with the older methods described in, e.g., DE-A1-29,37,321 (Stefanescu), DE-C1-34,12,024 (Lampic) or JP-52,026,039 (Komatsu), as those methods were heavily laden with scrap problems. However, as mentioned above, the production of CGI is still quite modest. One important reason for this is that it has not been possible hitherto to reliably control the production of CGI in any continuous or semi-continuous processes, but only in batchwise processes.

By "continuous process" is here basically meant a process for continuously providing molten iron that solidifies as CGI, for instance for casting in moulds arranged in a continuously running moulding line, i.e. a process from which an unbroken stream of such molten iron can be obtained continuously without any interruption of the process for feeding of raw material or removal of treated iron, as distinct from a "batch process", by which is meant production and dispensing of individual parcels of molten iron that solidifies as CGI, optionally followed by a subsequent similar batchwise operation; by a "semi-continuous process" is meant an overall process comprising both a batchwise subprocess and a continuous subprocess, e.g. a process involving batchwise treatment and feeding of raw material to a reactor, from which the final products could be obtained on a continuous basis, i.e. without any interruption; in the present case, this means that the process provides an option to produce a continuous strand of CGI, although it is still possible to produce independent castings of CGI, optionally in a continuously running moulding line.

One important difference between a batch process, on one hand, and a continuous or a semi-continuous process, on the other hand, is that in a batch process the product properties in principle cannot be changed or adjusted from one produced item to another, but only when a new batch of material is prepared, while in a process that comprises at least one controlled continuous subprocess such changes or adjustments in principle can be made at any point in time; in the present case, this is effected by on-line control of the contents of inoculation agents (and optionally also of graphite shape modifying agents) in the melt iron at the latest possible stage of the production process prior to casting, as will be discussed in more detail later. For the sake of simplicity, and justified by the difference discussed above, both the concept of "continuous" as well as that of "semi-continuous" processes will in this document be embraced by the term "continuous process".

The fact that in order to be economically rewarding the large scale production of near-net-shape cast metals or alloys will sooner or later require a continuous manufacturing process would be obvious to those active in this field of technology. A continuous process would have a number of advantages in relation to a batch process, as should be clear to any person skilled in the art. From the aspect of logistics, for instance, continuous manufacturing processes would be advantageous in that the potential danger of "congested sections" or "bottlenecks" in the production chain would be considerably smaller, providing for optimized economic use of the production plant.

As mentioned in the introduction, one of the major reasons why CGI is still produced by batch-wise processes rather than by continuous processes is because the process control problems of the older techniques have not allowed for reliable continuous CGI production processes.

All technical development of any practical significance within this field has been directed towards solving the problem of batch-wise manufacturing processes. The aforesaid patent specifications thus describe methods which are directed to controlling and regulating the composition of a given melt of limited volume, i.e. a batch. A sample is taken from this batch and if the result of the thermal analysis shows deviations from specified values, the composition of the entire batch is corrected, i.e. if such correction is at all possible; if the composition of the batch cannot be corrected, the entire batch is diverted.

Subsequent to taking the sample and correcting the composition of the melt, the molten iron is cast in accordance with known methods as quickly as possible, and normally within 5–20 minutes. Many of the additives in the melt react chemically and become inactive at liquid iron holding temperatures when the waiting time is too long. Thus, batch production process conditions do not allow more than one sampling occasion with each batch, and are intolerant of process interruptions. The sample is taken from a transfer ladle and the melt shall have time to be de-slagged and transported to the final treatment station during the time of analyzing the sample, wherein the results of the analysis are then used to make any necessary adjustment to the melt prior to casting. A terminating thermal analysis is unsuitable because this would reduce the available casting time. Thus, although advantageous in many ways, the prior art processes would not seem to form a good basis for any continuous manufacturing process, since there are no opportunities provided for on-line control of the product properties according to said prior art, but only for adjustment of one batch at the time.

During batch production methods, a major quantity of inoculating and graphite-modifying agents are introduced into the melt at an early stage of the process, whereafter the thermal analysis sampling process is carried out and corrections are made immediately prior to casting. This major quantity of inoculating agent must be considerably larger than the amount corresponding to the required content in the iron to be cast, since the inoculating agent has a limited effect; the inoculating agent stimulates the formation of graphite crystals, but if casting and therewith cooling of the melt is not eminent, a number of the crystallization nuclei thus formed will redissolve in the melt or be physically removed from the melt by, for example, flotation. It would of course be desirable to reduce the used quantity of inoculating agent to an amount that corresponds to the required content in the iron to be cast.

The amount of sulphur present in the cast iron melt introduced into the process must be kept at a low level; sulphur per se is undesirable in CGI and therefore must in all events be removed during the course of the process. A high S-content will also reduce the accuracy of the thermal analysis. Any sulphur present will react with Mg, which is the graphite shape modifying agent commonly used in such processes. As made evident in SE-B-469,712, only dissolved Mg in elementary form has a graphite shape-modifying effect. When analyzing the measuring result, a high S-content causes uncertainty as to whether or not the major part of the Mg added to the system has reacted completely with the sulphur present at the time of taking the sample, and therewith uncertainty as to the extent to which the melt needs to be corrected. It would of course be desirable to find a way to reduce or even remove these uncertainties.

SUMMARY OF THE INVENTION

It is an object of the present invention to provide for a continuous method of CGI production, having the desirable properties indicated above, by means of an improved way of performing process control.

By deviating from the direction in which the prior art has developed and instead thermally analyzing the fully treated iron, the aforedescribed problems are overcome and CGI can be produced by a continuous process.

According to the present invention, inoculating agents need only be added immediately prior to casting, i.e. in exact quantities, which has not been possible in conventional methods, where inoculating agent is added early in the process and then in considerable, but necessary excess amounts. In the case of the present invention, however, the ability of the fully treated cast iron to crystallize is measured and the result of this measurement is used for feedback control of the supply of inoculating agent, this supply being effected at the last possible stage of the treatment process, so as to optimize the amount of inoculating agent introduced to the system. Since the inoculating agent will normally include FeSi, it will also influence the C.E.-value, and hence the result is also fed back to step II and used to increase or reduce the addition of agents for adjusting the carbon and/or silicon contents of the iron as necessary.

When practicing the present invention, it is easier to accommodate iron melts with high S-contents, if such melts have to be used. A desulphurization step can be provided prior to transferring the molten cast iron into the conditioning furnace, or, as an alternative, a given quantity of graphite shape modifying agent can be added which, in addition to the amount required to modify the structural properties, also includes a stoichiometric quantity corresponding to the S-content of the iron, so that, in principle, all sulphur will have reacted by the end of the process, and so that the resultant CGI will be free from sulphur in solution. As mentioned in the aforegoing, however, this reaction is far from being instantaneous and impairs the samples taken during the course of the process. When practicing the present invention, however, the sample is taken at the end of the process from an iron melt which, on average, has been kept for quite a long period of time in the conditioning furnace. With each new batch of melt transferred to the conditioning furnace, the active S-concentation of the respective new batch is reduced by mixing the batch with melt of lower active S-concentration present in the conditioning furnace, and the added sulphur is given time to react more completely prior to taking the respective sample.

The production of molten cast iron in step I is conveniently effected in a melter, for instance a cupola furnace or an electric furnace, and may consist of a duplex-process including a melting and a treatment furnace. The raw material used to produce the melt may be iron scrap, virgin iron raw material, foundry returns, or other conventional iron foundry charge materials, or combinations of these; even though not preferred, the raw material may have a relatively high S-content.

The C.E.-value of the melt is adjusted in step II with the aid of carbon and/or silicon or low carbon iron, which are added in quantities corresponding to the result of the thermal analysis of the melt that has just been cast; the principle on which the C.E. is adjusted is thus essentially in accordance with the method described in SE-B-470,091.

According to one embodiment of the inventive method, below referred to as embodiment A, the melt is then transferred in to a reaction vessel, normally in the form of a ladle, in which the melt is subjected to a base treatment process in which a graphite shape modifying agent, such as Mg for instance, is added in an amount governed by the aforesaid analysis result, essentially in accordance with the methods described in SE-B-444,817 and SE-B-469,712. The Mg can be added to the melt in accordance with any appropriate conventional method. Mg-containing alloys (e.g. FeSiMg-alloy containing 45–60% Fe, 40–70% Si and 1–12% Mg) can be used in a so-called sandwich-process (i.e. the alloy is placed on the bottom of the reaction vessel and the melt poured over the alloy), although preferably pure Mg will be added, since this generates less slag. Pure Mg can be added in wire form for instance, or in a so-called GF-converter (GF=Georg Fisher AG). As mentioned in the aforegoing, it is not necessary to include an inoculating agent in the base treatment process, although there is nothing to prevent the basic process from including the addition of an inoculating agent.

Upon completion of the optional base treatment process, the slag is removed from the melt and the melt is transferred to a conditioning furnace, which may be an open furnace when, for instance, the process conditions are such that the melt is protected from atmospheric oxygen by a continuous slag layer, although a closed furnace is preferably used, this furnace being preferably provided with an inert shielding gas atmosphere. This minimizes undesirable oxidation of the melt constituents, and then particularly readily oxidized graphite shape-modifying agents such as Mg. When using a shielding gas, the gas used may be any non-oxidizing gas such as nitrogen or a nobel gas, for instance, or a mixture thereof.

According to one embodiment of the invention, there is used a closed conditioning furnace which is also preferably pressurized. In addition to pressurizing the furnace and therewith further reducing the ingress of air to the melt in the conditioning furnace, when the conditioning furnace is appropriately constructed the furnace pressure can be regulated so as to control emptying of the melt into casting moulds in an advantageous manner; this will be described in more detail below.

The furnace may, for example, be of the PRESSPOUR type, for instance a furnace of the type sold by the company ABB. The batch charged is mixed in the conditioning furnace together with the existing melt.

The refilling of the melt contents of the furnace is typically up to about 25%, since this turnover level has been found to provide a good content equalizing effect.

According to embodiment A further graphite shape modifying agent, for instance Mg, may be added to the melt in the conditioning furnace, if so required. The Mg can be supplied in the form of steel-sheathed Mg-cored wire or rod, which is fed into the furnace through a closable opening in the furnace cover or lid. As with the earlier additions, the amount of Mg added to the system is governed by the result of the thermal analysis of the fully treated CGI either, in or immediately upstream of the casting mould. There is a danger of gas forming in the melt when at least certain graphite shape modifying agents are added thereto, such as Mg for instance, which readily vaporizes when entering the melt. When the conditioning furnace is pressurized the gas thus generated is liable to disrupt the pressurization control system. Consequently, the pressure in the conditioning furnace is preferably reduced when adding a graphite shape modifying agent to the melt while in the conditioning furnace.

In another embodiment, below referred to as embodiment B, being alternative to embodiment A, the molten cast iron is transferred from the conditioning furnace to a small pouring ladle before being poured into casting moulds, and the total quantity of graphite shape modifying agent is added into the ladle in accordance with the aforementioned melt regulating principle, i.e. the base iron held in the conditioning furnace has not previously been treated with magnesium.

The sequence of production steps is terminated by taking a sample for thermal analysis. The sample is preferably taken in a pouring basin or sprue system, although it can also be taken from the casting stream or, for instance, from a pouring ladle, if any. The sample may be taken manually, for instance with the aid of a hand-held lance, or fully automatically or semi-automatically; in this context semi-automatic sampling can imply that the actual sample is taken automatically while the probes are changed manually. The sampling devices may, for instance, be of the kind described in SE-B-446,775. Since a given period of time must lapse in order to enable the melt already present in the conditioning furnace to mix with each new batch of molten iron added thereto before melt taken from the furnace is able to provide an analysis result which is representative of the furnace contents, it is necessary to allow a few moulds, generally about 4–5 moulds, to pass before a sample is taken after each refilling of the conditioning furnace. On the other hand, in case of embodiment A, it is necessary to sample at a rate which is sufficiently rapid to ensure that the analysis result can be used to modify the next base treatment process. When determining the duration of this mixing time, the important parameters that must be taken into consideration include the length of time taken to fill the casting moulds, the volumetric capacity of the moulds, the size of the conditioning furnace and, where applicable, the size of the ladle in which the base treatment is carried out.

The procedures taken when starting up the process are to a large part dependent on the initial conditions: The plant may have been used to produce gray or ductile iron prior to starting up the process for instance, or the conditioning furnace may be more or less filled with melt. Whichever the case may be, the conditioning furnace is first filled with molten cast iron, optionally base treated with Mg, until the sulphur and/or additive concentrations of the melt lie essentially in the correct ranges for the production of CGI. The furnace is filled generally on the basis of experience, optionally together with the aid of chemical analysis of samples taken in the spout.

According to embodiment A, at start-up the furnace is filled to roughly three-quarters of its capacity, after which melt is tapped-off until a stable and uniform level of inoculating agent is obtained, this level generally corresponding to about 2–4 casting moulds, whereafter casting is interrupted temporarily and a thermal analysis sample is taken. The result of this analysis influences the base treatment of the next batch of melt in the reaction vessel, this melt later filling up the conditioning furnace, and also indicates the possible need to add Mg to the melt in the conditioning furnace to quickly adjust the system, whereafter production can be started. In the case of planned or undesirable stoppages in operation, the pressure in the furnace is reduced, after having stopped the production, so that melt in the furnace spout will be drawn back into the furnace and therewith lower the fading or oxidation of Mg. Since the fading rate per unit of time in the furnace is known, it is possible to calculate the reduction in active Mg during the stoppage period. A corresponding amount of Mg can then be added to the melt after the stoppage, and production then restarted.

The start-up and shut-down procedures are essentially the same as indicated above, where applicable, when practicing embodiment B. The ladles should be preheated. In the case of stoppages, the ladles should be emptied, if possible into moulds but otherwise back into the conditioning furnace within a few minutes after the stop, and, in case of any longer stop, be reheated; when restarting the production, the ladles are simply filled again.

BRIEF DESCRIPTION OF THE DRAWINGS

The inventive method will now be described in more detail with reference to a number of examples and also with reference to the accompanying drawings, in which like reference numerals indicate like objects.

DETAILED DESCRIPTION

Figure 1:
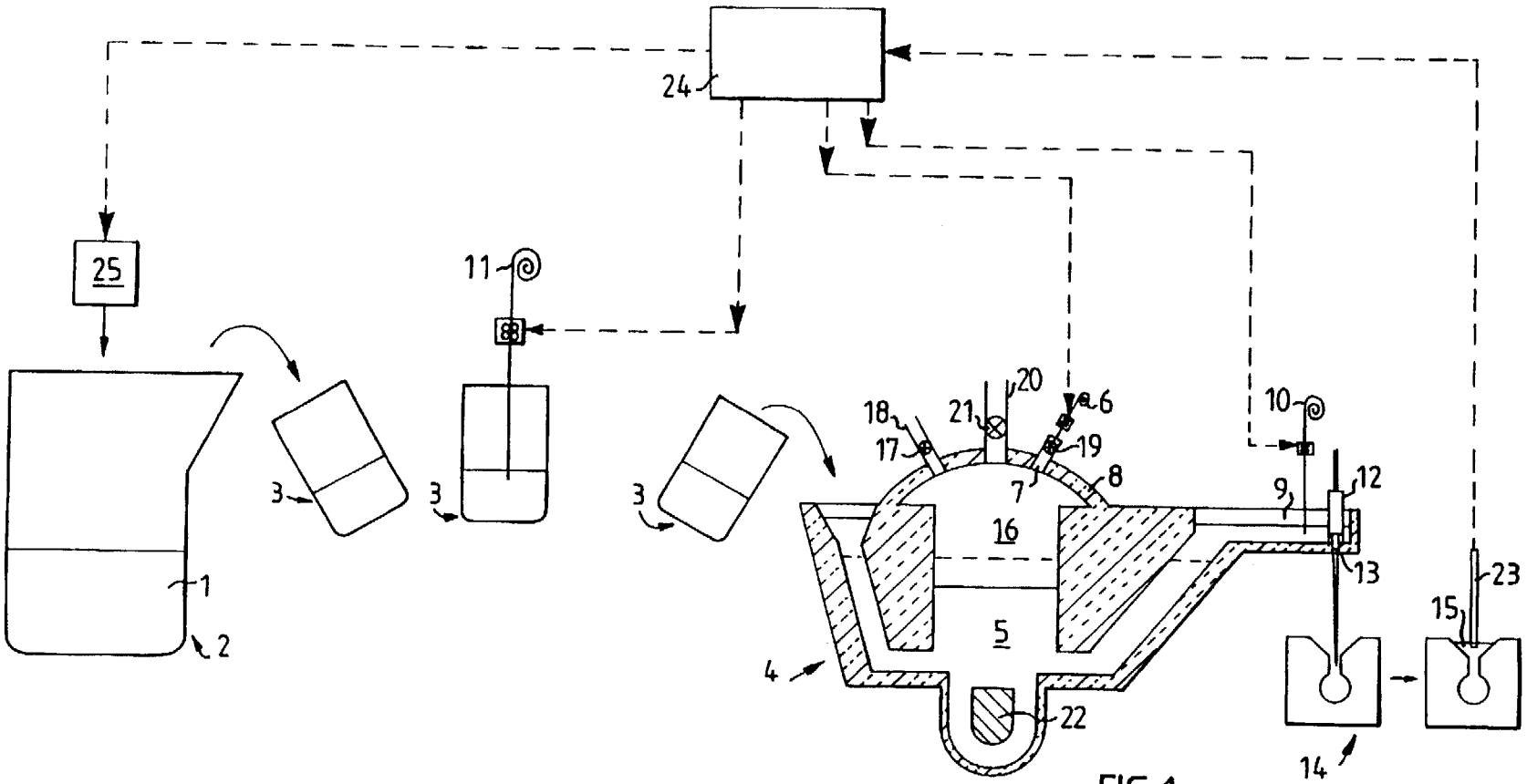
FIG. 1 is a principle schematic overview of embodiment A of the method according to the present invention.

In the case of the embodiment illustrated in FIG. 1, which is an example of the previously described embodiment A, there is first prepared an iron melt 1 in a furnace 2. In this case, the melt is produced from iron scrap. The C.E. of the melt is adjusted in the furnace 2 by adding carbon and/or silicon and/or steel to the melt, as indicated at 25. The melt is then transferred to a ladle 3, in which the melt is subjected to a base treatment process, consisting of the addition of Mg 11 in some suitable form. Subsequent to this base treatment, slag is removed from the melt surface and the melt is transported to and introduced into a closed conditioning furnace 4, in which a pressurized inert gas atmosphere is maintained and which is of the so-called pressure pouring type sold by the company ABB under the trademark PRESSPOUR®. Melt is tapped from the furnace in a controlled fashion, either by controlling the gas overpressure in the furnace space 16—with the aid of a slide valve 17 on the gas delivery line 18—or with the aid of a stopper rod 12 which fits into the tapping hole 13 in the spout 9, or by a combination of these control methods. The melt 5 is heated by means of an induction heating unit 22 and is therewith also remixed to some extent. The batch of melt introduced into the conditioning furnace 4 is mixed with the melt 5 already present therein. About 75% of the maximum capacity of the furnace is utilized when the process is continuous. Further Mg may be supplied to the furnace 4 when necessary. The Mg is supplied in the form of steel-sheathed Mg-cored wire or rod 6, which is fed into the furnace 4 through a closable opening 7 provided in the furnace casing 8. As with other additions, the Mg-addition is also governed by the result of the thermal analysis of the cast CGI. The opening 7 is provided with a slide valve or lid 19. The arrangement also includes a chimney 20 (that optionally may be identical with the opening 7) through which particulate MgO, Mg-vapour, and other gases within the furnace environment are ventilated and which is provided with a slide valve or lid 21 mounted in the casing 8. The valve 17 is open for continuous gas delivery during operation, whereas the valves 19 and 21 are closed. When needing to introduce the Mg-wire 6 into the furnace, the furnace pressure is first lowered resulting in level of melt in the spout 9 falling to the level shown in broken lines. This operation takes about 10–20 seconds to effect. The valve 21 in the chimney 20 and the Mg infeed valve 19 are then opened, which takes about 5 seconds. Mg-cored wire 6 is fed for about 30 seconds into the furnace. The valves 19 and 21 are then closed, which takes a further 5 seconds. Finally, the valve 17 is opened and the pressure is increased to its normal operating level, which takes about 20 seconds. The time taken to feed Mg-rod 6 into the conditioning furnace is thus about 70 seconds in total. Inoculating agent 10 is delivered to the spout 9 of the furnace in accordance with the aforesaid regulating principle immediately prior to tapping-off the melt.

Tapping of melt from the furnace 4 is controlled with the aid of the stopper rod 12. The method sequence is terminated by taking a sample 14 for thermal analysis with the aid of a sampling device 23, not described in detail here. In the illustrated case, the sample is taken in the pouring basin or sprue system 15 of a casting mould 14. In order to ensure that the analysis result will represent the contents of the furnace, 4–5 casting moulds are allowed to pass after each replenishment of the conditioning furnace, before taking a sample. The sample is analyzed with the aid of a computer 24, not described in detail here; the broken line arrows indicate the flow of information to and from the computer 24.

Figure 2:
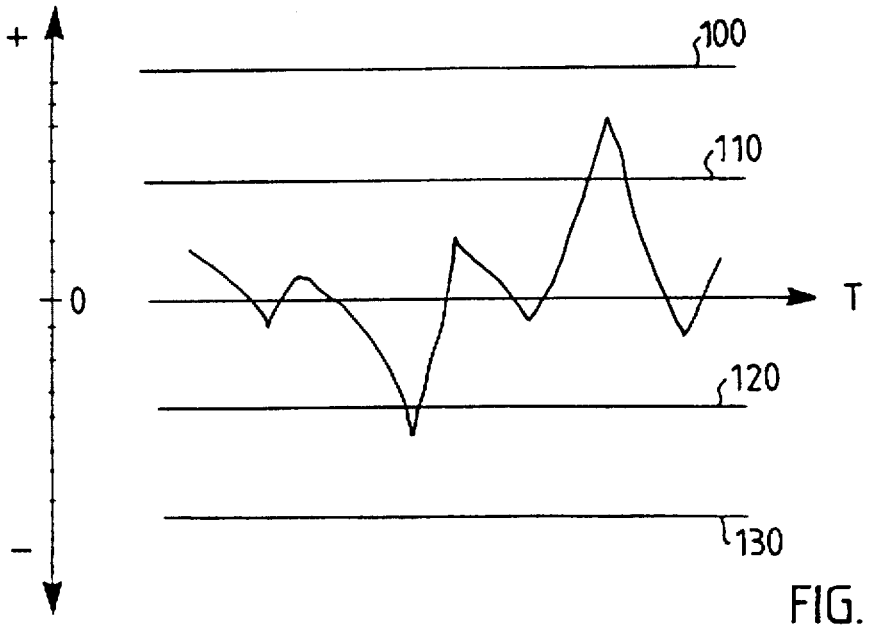
FIG. 2 is an example of a control diagram by means of which the content of graphite shape modifying agents in the melt is controlled while performing the method according to FIG. 1.

The additions of graphite shape modifying agents to the system are regulated suitably in accordance with the principles described below, wherein reference is made to the control diagram in FIG. 2 in which the control value for the content of graphite shape modifying agent is plotted on the y-axis as a function of time, which is plotted on the x-axis. The positive values of the y-coordinate indicate excesses in relation to the control value of graphite shape modifying agent, while the negative values indicate a deficiency. The control value coincides with the x-axis, i.e. when y=0. The reference signs have the following significance:

100=upper specification limit

110=upper control limit

120=lower control limit

130=lower specification limit

When the actual value lies within the control limits (i.e. between the lines 110 and 120) and the trend does not point away from this area, no change is made to the Mg-addition;

the same amount of Mg is included in the next base treatment process as in the preceding process. If the actual value lies above the upper control limit 110, but below the upper specification limit 100, the Mg-addition is decreased in the next base treatment process. If the actual value lies in the corresponding lower range (between the lines 120 and 130), the Mg-addition is increased in the next base treatment process. If the actual value lies above the upper specification limit 100, no more melt is tapped from the conditioning furnace until the Mg-content has faded (intentional), or the furnace melt is diluted with a melt with a lower Mg-content until the Mg-content has reached an acceptable level. A scrap warning is given at the same time. If the conditioning furnace is not full to capacity, a charge containing less Mg can be added to the existing melt. Tapping of melt from the furnace is also interrupted when the actual value falls beneath the lower specification limit 130, although in this case Mg-wire is fed to the furnace, while issuing a scrap warning.

The addition of inoculating agent to the melt is controlled in a similar way. The reference signs in FIG. 3 have the same significance as those in FIG. 2. If the actual value lies within the control limits (between the lines 110 and 120) and the trend does not point away from this area, no change is made to the amount of inoculating agent added to the system. If the actual value lies outside the control limits, the amount of inoculating agent added to the melt in the spout of the conditioning furnace is either increased or decreased; a scrap warning is also issued when the actual value lies outside the specification limits (the lines 100 and 130 respectively).

Figure 3:
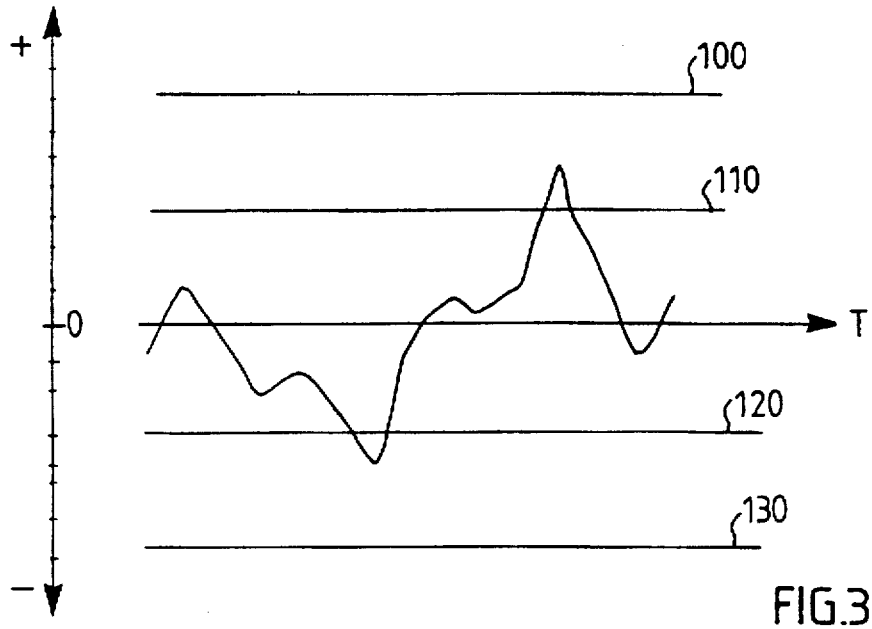
FIG. 3 is an example of a control diagram similar to the diagram of FIG. 2 but concerning the amount of inoculating agent in the melt.
Figure 4:
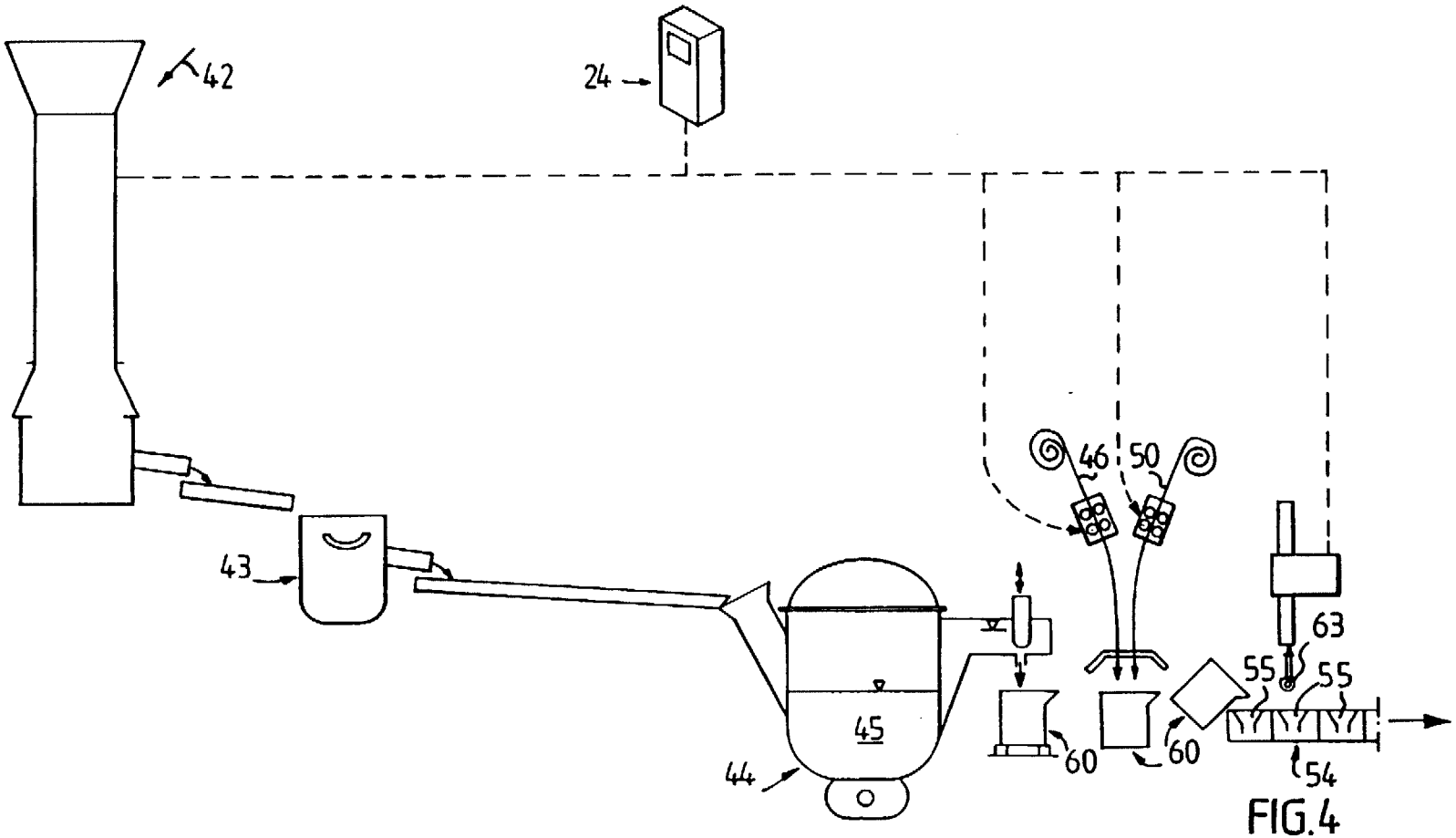
FIG. 4 is a principle schematic overview of embodiment B of the method according to the present invention.

In the case of the embodiment illustrated in FIG. 4, which is an example of previously described embodiment B, an iron melt is prepared in a furnace 42. The melt is then transferred to a vessel 43, in which the melt is desulphurized, according to any suitable known process, to a weight percentage of about 0.005–0.01% S. Simultaneously, carbon is added to a weight percentage of about 3.7% C. in order to adjust the C.E.-value of the melt. Subsequent to this, slag is removed from the melt surface and the melt is transported to and introduced into a pressurized conditioning furnace 44 (similar to the furnace 4 in the embodiment A example), having a capacity of about 6 to 65 tons, from which melt is tapped in a controlled manner according to any of the methods indicated in the embodiment A example. The batch of melt introduced into the conditioning furnace 44 is mixed with the melt 45 already present therein, while optional alloying agents, e.g. Cu or Sn, may also be added; such alloying agents may also, or alternatively, be added at some other suitable point of the process. From the conditiong furnace, the molten iron is poured into a small treatment or pouring ladle 60. The melt in these ladles is then treated with Mg-cored wire 46 and inoculating agent 50 immediately prior to casting in moulds 54. The method sequence is terminated by taking a thermal analysis sample 63 from the ladle 60 or from the pouring basin or sprue system 55 of casting moulds 54. As with other additions, the additions of Mg as well as of inoculation agent are governed by the result of the thermal analysis of the cast CGI. The control and regulating principles described in connection with FIG. 2 and 3 are essentially applicable also in the case of this latter embodiment.

It will be understood that the invention is not restricted to the described and illustrated exemplifying embodiments thereof and that the described method can be modified in many ways within the scope of the invention and within the expertise of the person skilled in this art. For instance, an additional thermal analysis sampling may be carried out following the optional base treatment, in order to secure an acceptable quality of the feed to the conditioning furnace. Other method principles, devices, components, agents, etc. than indicated above may of course also be used within the scope of the present invention.

We claim:

1. A method for continuously providing pre-treated molten iron for casting objects which solidify as compacted graphite iron, comprising the steps of:

(a) continuously producing a succession of batches of desulfurized molten cast iron, thereby providing a feedstock thereof;

(b) transferring increments of said feedstock of desulfurized molten cast iron one after another to a conditioning furnace and intermittently dispensing desulfurized molten cast iron from said conditioning furnace into a succession of individual casting molds, said transferring being conducted so as to maintain the quantity of desulfurized molten cast iron in said conditioning furnace within predetermined limits, despite said dispensing;

(c) periodically taking a sample of desulfurized molten cast iron from a respective selected one of said individual casting molds into a container and allowing the sample to solidify to cast iron from a state in which the sample and the container are substantially in thermal equilibrium at a temperature above the crystallization temperature of the sample;

(d) while allowing each sample to solidify to cast iron, recording time-dependent temperature changes of the sample and using the resulting recorded changes for establishing structural properties and carbon equivalent of the cast iron;

(e) comparing the structural properties and carbon equivalent established in each practice of step (d), with known structural properties and carbon equivalent equating to acceptable compacted graphic iron; and (f) upon determining as a result of a practice of step (e) that the established structural properties and/or carbon equivalent of the cast iron from a respective sample deviate from the respective said known structural properties and carbon equivalent by more than given respective predetermined amounts, practicing at least one of:

(i) adjusting the carbon equivalent of a batch or increment of said feedstock, by adding at least one of carbon, silicon and steel thereto;

(ii) adding a correspondingly varied amount of at least one graphite shape-modifying agent to said desulfurized molten cast iron, in relation to an amount of graphite shape-modifying agent added to a respective preceding batch or increment and/or in at a preceding incident of addition, by making a corresponding adjustment of addition thereof to at least one of said batch, said increment and said conditioning furnace; and (iii) adding a correspondingly varied amount of at least one inoculating agent to said conditioning furnace immediately prior to pouring desulfurized molten cast iron therefrom into a respective said individual casting mold in a respective practice of step (b).

2. The method of claim 1, comprising:

practicing step (f)(ii) on respective batches of said desulfurized molten cast iron in a reaction vessel; and transferring said batches from said reaction vessel.

3. The method of claim 1, further comprising:

maintaining said conditioning furnace substantially closed except when transferring desulfurized molten cast iron thereto or therefrom and when adding graphite shape-modifying agent or inoculating agent thereto.

4. The method of claim 3, further comprising:

providing said conditioning furnace with a protective internal atmosphere of inert gas.

5. The method of claim 3, further comprising:

internally pressuring said conditioning furnace.

6. The method of claim 5, further comprising:

reducing internal pressurization of said conditioning furnace when adding graphite shape-modifying agents thereto.

7. The method of claim 1, wherein:

each respective selected one of said individual casting molds has a gate or sprue system, and, in practicing step (c), each said sample is taken from a respective gate or sprue system.

8. A method for continuously providing pre-treated molten iron for casting objects which solidify as compacted graphite iron, comprising the steps of:

(a) continuously producing a succession of batches of desulfurized molten cast iron, thereby providing a feedstock thereof;

(b) transferring increments of said feedstock of desulfurized molten cast iron one after another to a conditioning furnace, intermittently dispensing desulfurized molten cast iron from said conditioning furnace into at least one ladle, and pouring desulfurized molten cast iron from said at least one ladle into a succession of individual casting molds, said transferring being conducted so as to maintain the quantity of desulfurized molten cast iron in said conditioning furnace within predetermined limits, despite said dispensing;

(c) periodically taking a sample of desulfurized molten cast iron from a respective selected one of said individual casting molds into a container and allowing the sample to solidify to cast iron from a state in which the sample and the container are substantially in thermal equilibrium at a temperature above the crystallization temperature of the sample;

(d) while allowing each sample to solidify to cast iron, recording time-dependent temperature changes of the sample and using the resulting recorded changes for establishing structural properties and carbon equivalent of the cast iron;

(e) comparing the structural properties and carbon equivalent established in each practice of step (d), with known structural properties and carbon equivalent equating to acceptable compacted graphic iron; and (f) upon determining as a result of a practice of step (e) that the established structural properties and/or carbon equivalent of the cast iron from a respective sample deviate from the respective said known structural properties and carbon equivalent by more than given respective predetermined amounts, practicing at least one of:

(i) adjusting the carbon equivalent of a batch or increment of said feedstock, by adding at least one of carbon, silicon and steel thereto;

(ii) adding a correspondingly varied amount of at least one graphite shape-modifying agent to said desulfurized molten cast iron, in relation to an amount of graphite shape-modifying agent added to a respective preceding ladle of said feedstock, by making a corresponding adjustment of addition thereof to a respective said ladle; and (iii) adding a correspondingly varied amount of at least one inoculating agent to a respective said ladle prior to pouring desulfurized molten cast iron therefrom into a respective said individual casting mold in a respective practice of step (b).

9. The method of claim 8, further comprising:

maintaining said conditioning furnace substantially closed except when transferring desulfurized molten cast iron thereto or therefrom and when adding graphite shape-modifying agent or inoculating agent thereto.

10. The method of claim 9, further comprising:

providing said conditioning furnace with a protective internal atmosphere of inert gas.

11. The method of claim 9, further comprising:

internally pressurizing said conditioning furnace.

12. The method of claim 8, wherein:

each respective selected one of said individual casting molds has a gate or sprue system, and, in practicing step (c), each said sample is taken from a respective gate or sprue system.

* * * * *